US005718571A

United States Patent [19]

Rozek

[11] Patent Number: 5,718,571

[45] Date of Patent: Feb. 17, 1998

[54] VALVE ASSEMBLY

[75] Inventor: Roy J. Rozek, Plymouth, Wis.

[73] Assignee: Thomas Industries Inc., Sheboygan, Wis.

[21] Appl. No.: 748,673

[22] Filed: Nov. 13, 1996

[51] Int. Cl.[6] ..... F04B 39/10

[52] U.S. Cl. ..... 417/566; 417/571; 137/512.4

[58] Field of Search ..... 417/566, 571; 137/512 A

[56] References Cited

U.S. PATENT DOCUMENTS

| | | | |
|---|---|---|---|
| 3,058,140 | 10/1962 | Henss | 417/566 X |
| 4,275,999 | 6/1981 | Hetzel et al. | 417/299 |
| 4,437,490 | 3/1984 | Demers et al. | 137/512.4 |
| 4,573,888 | 3/1986 | Kitchin | 137/512.4 X |
| 5,022,833 | 6/1991 | Kandpal et al. | 417/571 |
| 5,213,025 | 5/1993 | Rozek | 92/109 |
| 5,213,125 | 5/1993 | Leu | 137/15 |
| 5,385,140 | 1/1995 | Smith | 137/512.4 X |
| 5,456,287 | 10/1995 | Leu | 137/855 |
| 5,476,367 | 12/1995 | Zimmermann et al. | 417/566 X |

*Primary Examiner*—Richard E. Gluck
*Attorney, Agent, or Firm*—Quarles & Brady

[57] ABSTRACT

A valve assembly for a pumping apparatus includes a cylinder sleeve having a head end with inlet and outlet ports surrounded by a recess. An elastomer seal element is received in the recess and includes a peripheral portion that encircles the ports and a bridge portion that extends across the space between the ports. Integral flapper valves extend into the spaces between the peripheral portion and the bridge portion. A valve head with inlet and exhaust chambers has a flat surface that seats against the seal element. The cross-section of the peripheral and bridge portions are compressible, such as that of an O-ring.

11 Claims, 4 Drawing Sheets

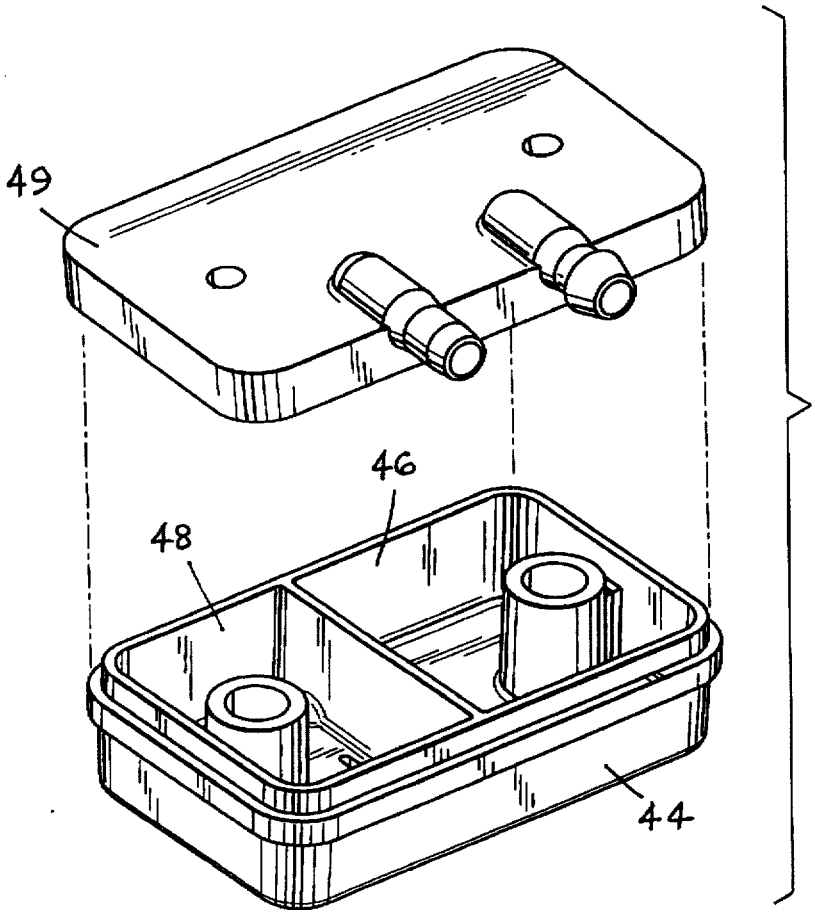
Fig. 10
Fig. 11
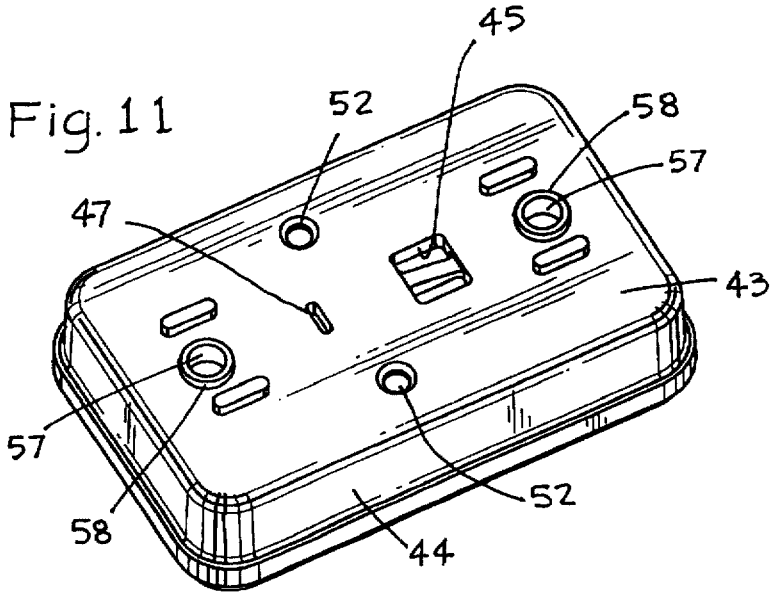

VALVE ASSEMBLY

This application claims the benefit of U.S. provisional application Ser. No. 60/006,567 filed Nov. 13, 1995.

BACKGROUND OF THE INVENTION

This invention relates to a valve assembly for a pumping apparatus, and more particularly to an improved assembly in which a valve head is joined to a cylinder head by a seal that includes flapper valves.

Flapper valves are often used in air compressors and vacuum pumps to open and close ports for intake and exhaust. The flapper valves are typically disposed on the head end of a cylinder that includes the ports. A valve head containing intake and exhaust chambers is usually attached to and sealed with the cylinder head. Examples of such flapper valve constructions are found in U.S. Pat. No. 4,275,999 issued Jun. 30, 1981 to Thomas R. Hetzel et al. for "Air Compressor With Ramped Intake Valve", U.S. Pat. No. 5,213,125 issued May 25, 1993 to Shawn A. Leu for "Valve Plate With Recessed Valve Assembly", and U.S. Pat. No. 5,456,287 issued Oct. 10, 1995 to Shawn A. Leu for "Compressor/Vacuum Pump Reed Valve".

SUMMARY OF THE INVENTION

The present invention involves the use of a new compressible seal to isolate the flapper valves used for intake and exhaust valving. The compressible seal is formed into a single element that includes the flexible flappers and which seals the end of a cylinder head with a valve head containing inlet and outlet chambers. The assembly of the valve head to the cylinder head and the cylinder to the compressor is accomplished in a simple manner using two screws.

In accordance with the invention, a valve assembly for a pumping apparatus includes a cylinder having a head end with spaced inlet and exhaust ports, a valve head having inlet and exhaust chambers adapted to communicate with the respective ports, and a flexible valve member disposed between the cylinder head end and the valve head, the valve member including a seal element that surrounds and isolates the ports and integral flapper valve portions extending from the seal element and overlying the ports.

Preferably, the seal element has a compressible cross-section such as an O-ring, and the valve member is formed of an elastomer. Furthermore, the seal element includes a peripheral portion that encircles the ports and a bridge portion that extends transversely across the space between the ports. In the preferred embodiment, the flapper valve portions extend from the bridge portion in opposite directions.

Although the features of the invention are particularly useful for nebulizer compressors, they are also useful for compressors generally and for vacuum pumps.

The foregoing and other objects and advantages of the invention will appear in the detailed description which follows. In the description, reference is made to the accompanying drawings which illustrate a preferred embodiment of the invention.

BRIEF DESCRIPTION OF THE DRAWINGS

FIG. 10 is an exploded view in perspective of the valve head assembly; and

FIG. 11 is a perspective view of the valve head member viewed from the underside.

DETAILED DESCRIPTION OF THE PREFERRED EMBODIMENT

Figure 1:
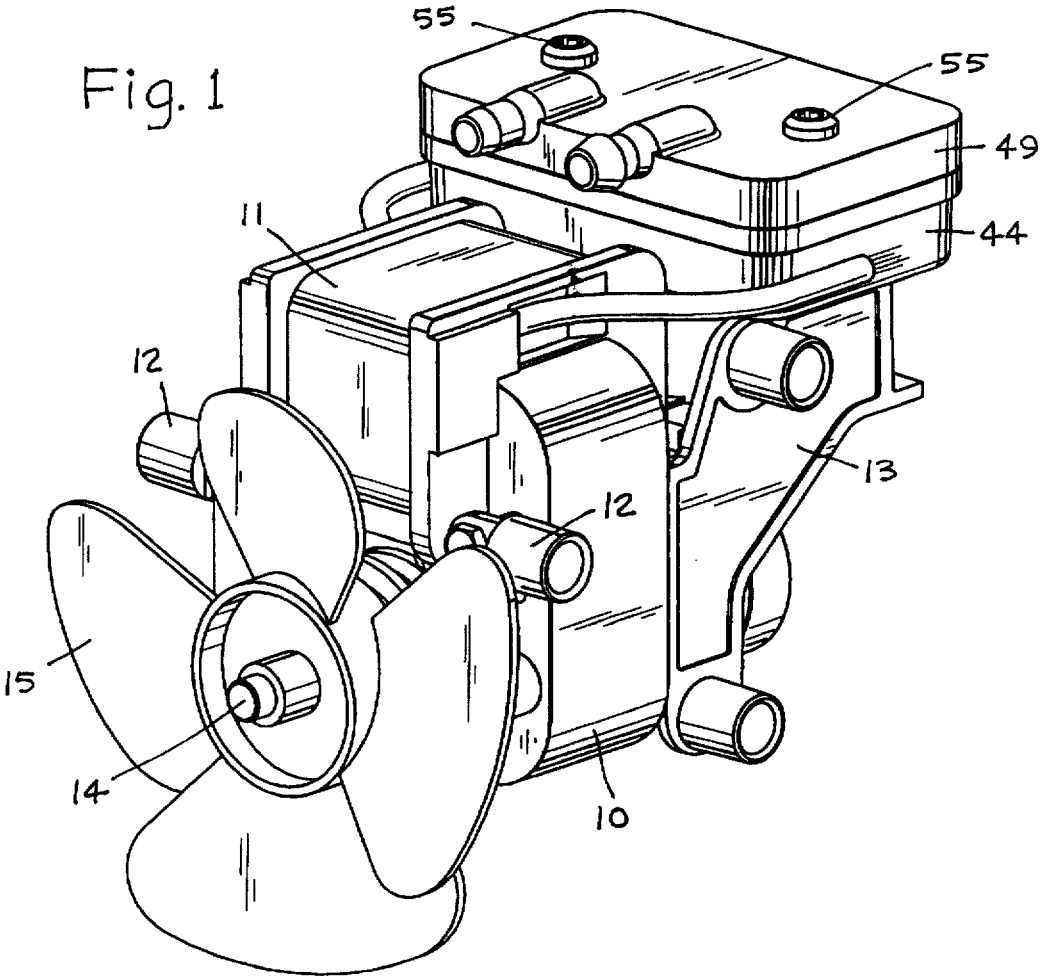
FIG. 1 is a view in perspective viewed from the fan end of a compressor incorporating the invention.
Figure 2:
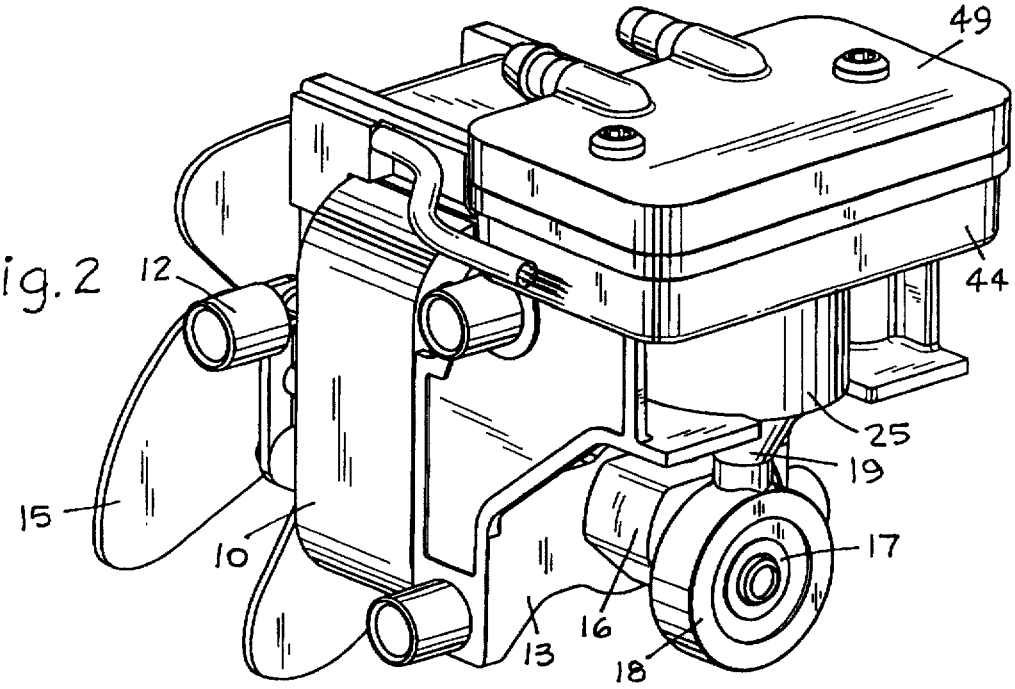
FIG. 2 is a view in perspective viewed from the piston end of the compressor.
Figure 3:
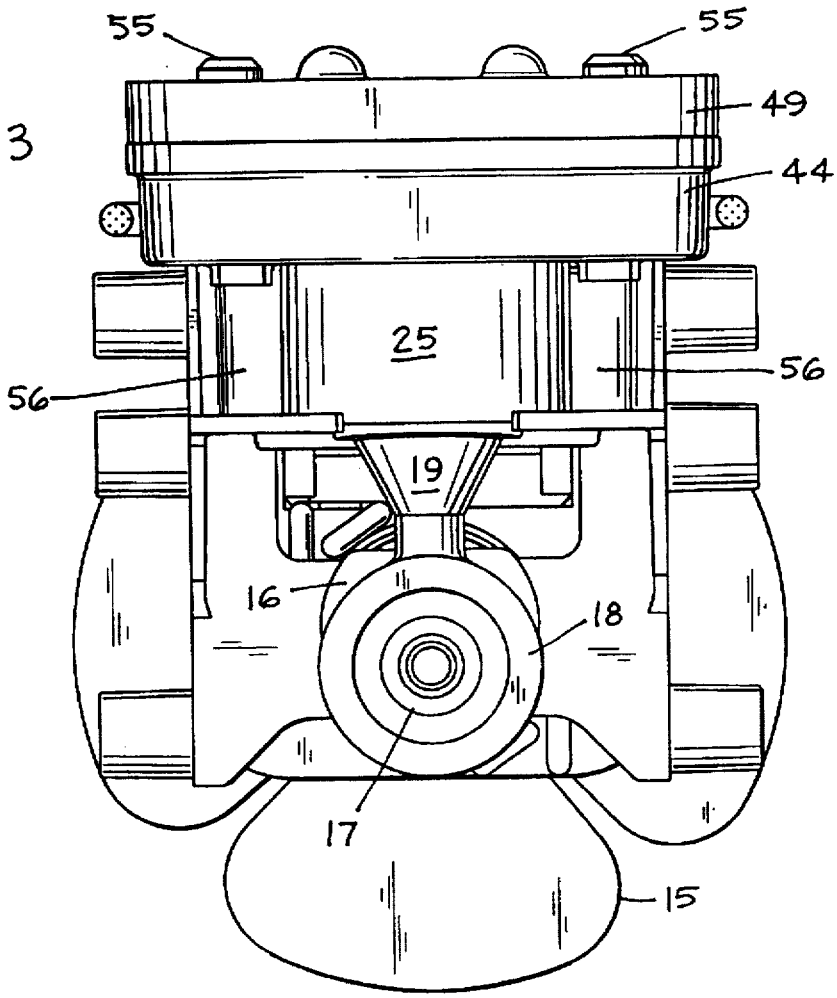
FIG. 3 is a view in elevation of the piston end of the compressor.
Figure 4:
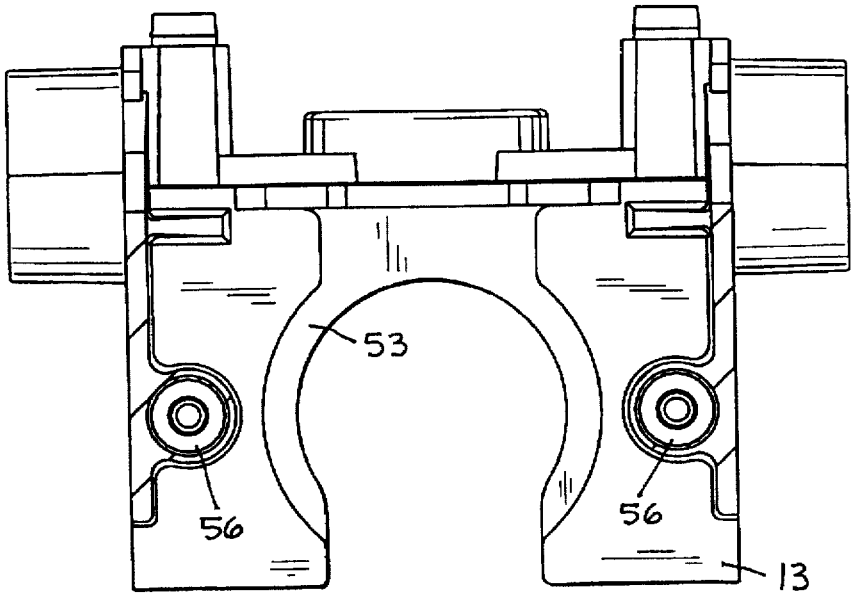
FIG. 4 is a top view of a mounting bracket for the cylinder and valve head of the compressor.

The compressor includes an electric motor having a laminated core 10 surrounded by a coil winding 11. Front and rear brackets 12 and 13, respectively, are attached to each other and to the laminated core 10. The brackets 12 and 13 mount bearings (not shown) that support a motor shaft 14. The motor shaft 14 mounts a fan 15 at one end and an eccentric block 16 at its other end. The eccentric block 16 mounts a bearing 17 that is fitted into a ring 18 on the lower end of a wobble piston 19. The piston 19 operates in a cylinder sleeve 25 that is formed integral with a cylinder head 26 (see FIG. 5). The piston may be of the style and form disclosed in U.S. Pat. No. 5,213,025 issued May 25, 1993 to Roy J. Rozek, for "Conical Rod Piston".

Figure 5:
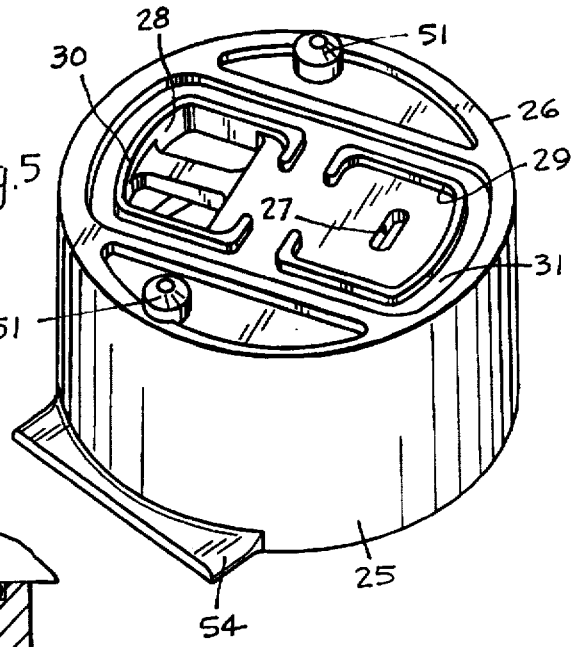
FIG. 5 is a view in perspective of the cylinder sleeve and head element.
Figure 9:
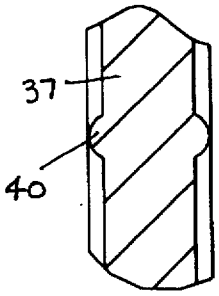
FIG. 9 is an enlarged detail of a portion of the section view of FIG. 8.

The cylinder head includes inlet and outlet ports 27 and 28, respectively. The ports 27 and 28 are each surrounded by an upstanding flange 29 and 30, respectively, that nearly encircles the ports, as shown in FIG. 5. The end of the cylinder head 26 extends to the same level as that of the flanges 29 and 30 so that a recess 31 is formed about and between the flanges 29 and 30. A flapper valve element 35 is formed from a elastomer such as fluorocarbon rubber. The valve element 35 has an outer peripheral portion 36 with a circular cross-section like that of an O-ring. A central beam portion 37 bridges the peripheral portion 36 and mounts a pair of flappers 38 extending in opposite directions from the beam portion 37 into the areas defined by the peripheral portion 36 and the beam portion 37. The center of the beam portion 37 has a narrow, expanded portion 40, which is of the same thickness as the peripheral portion 36, as shown in FIG. 9.

Figure 6:
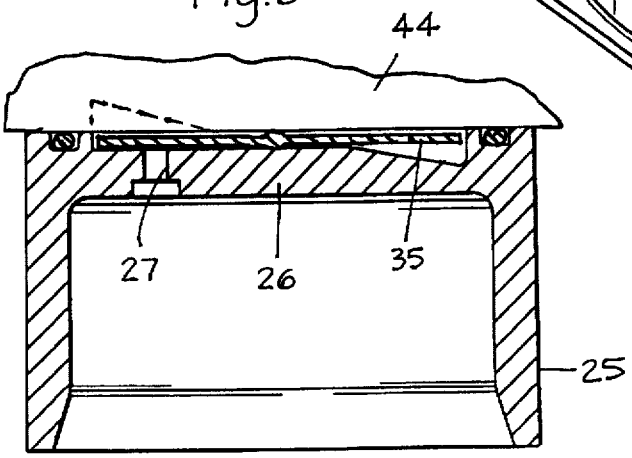
FIG. 6 is a vertical section view through the cylinder sleeve and head and the valve head member.
Figure 7:
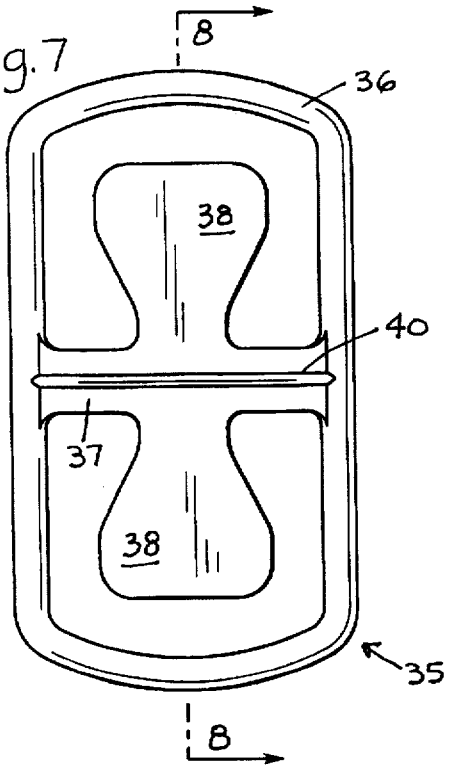
FIG. 7 is a plan view of the valve member.
Figure 8:
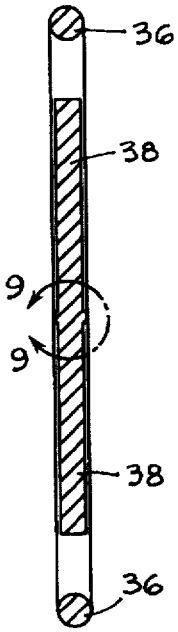
FIG. 8 is a view in section taken in the plane of the line 8—8 of FIG. 7.

The flapper valve member 35 is received in the recess 31 in the cylinder head 26. The O-ring-like peripheral portion 36 and beam portion 37 seal against the flat surface 43 of a valve head member 44 (see FIGS. 6 and 11). The valve head member 44 has an inlet port 45 leading from an inlet chamber 46 and an outlet port 47 leading to an outlet chamber 48. The valve head assembly is completed by a cover 49 having inlet and outlet fittings, as shown in FIG. 10.

The valve head member 44 is aligned on the cylinder head 26 by a pair of projections 51 on the cylinder head 26 being received in dead-ended holes 52 in the valve head member 44. The cylinder sleeve 25 is supported on a recessed ledge 53 in the rear bracket 13. The cylinder sleeve has a laterally extending visor 54 that fits in the openings forward or aft in the ledge 53. The cover 49, the valve head member 44, and the cylinder sleeve 25 with the cylinder head 26 are assembled to the bracket 13 by a pair of screws 55 that are threaded into posts 56 formed in the rear bracket 13. Openings 57 in the valve head member 44 for the screws 55 have surrounding flanges 58 that are received in the posts 56. In this manner, the cylinder sleeve 25 is located with respect to the bracket 13, the valve head assembly is interlocked with the cylinder head 26, and the valve head assembly is interlocked with the bracket 13, thereby assuring proper alignment of the cylinder with the piston and with the valve ports.

The present invention provides a simple but efficient one-piece valve member that both seals the valve head to the cylinder head and provides the flexible flapper valves. Although the flapper valve portions are shown as extending from the beam portion 37, they could extend from any part of the peripheral portion 36. Furthermore, the cross-section of the peripheral portion 36 need not be that of an O-ring. It could have the cross-section of a quad-ring, or a rectangle, or any other compressible shape.

I claim:

1. In a pumping apparatus including a piston operating in a cylinder having a head with intake and exhaust ports, and a valve head with intake and exhaust chambers adapted to communicate with the ports, the combination therewith of:

a flexible valve member disposed between the cylinder head and the valve head, the valve member including a peripheral seal element that surrounds and isolates the ports and integral flapper valve portions extending from the seal element and overlying the ports, the flapper valve portions having top and bottom surfaces that lie in common planes when not flexed, the seal element having a circular cross-section that extends above and below the planes of the flapper valve portions towards the cylinder head and the valve head.

2. A pumping apparatus in accordance with claim 1, wherein the seal element has a compressible cross-section.

3. A pumping apparatus in accordance with claim 1, wherein the valve member is formed of an elastomer.

4. In a pumping apparatus including a piston operating in a cylinder having a head with intake and exhaust ports, and a valve head with intake and exhaust chambers adapted to communicate with the ports, the combination therewith of:

a flexible valve member disposed between the cylinder head and the valve head, the valve member including a peripheral seal element that surrounds and isolates the ports and integral flapper valve portions extending from the seal portion and overlying the ports, the seal element includes a peripheral portion that encircles the ports and a beam portion that extends transversely across the space between the ports.

5. A pumping apparatus in accordance with claim 4, wherein the flapper valve portions extend into the areas defined by the peripheral seal portion and the beam portion.

6. A pumping apparatus in accordance with claim 4, wherein the cylinder head has an outer surface with a recess to receive the portions of the valve member and the valve head has a flat surface sealing against the valve member.

7. A valve assembly for a pumping apparatus, comprising:

a cylinder having a head end with spaced inlet and exhaust ports;

a valve head having inlet and exhaust chambers communicating with the respective ports; and a flexible valve member disposed between the cylinder head end and the valve head, the valve member including a peripheral seal element that surrounds and isolates the ports and integral flapper valve portions extending from the seal element and overlying the ports, the flapper valve portions having top and bottom surfaces that lie in common planes when not flexed, the seal element having a circular cross-section that extends from the planes of the flapper valve portions toward the cylinder head end and toward the valve head.

8. A valve assembly in accordance with claim 7, wherein the valve member is formed of an elastomer.

9. A valve assembly for a pumping apparatus, comprising:

a cylinder having a head end with spaced inlet and exhaust ports;

a valve head having inlet and exhaust chambers communicating with the respective ports; and a flexible valve member disposed between the cylinder head end and the valve head, the valve member including a peripheral seal element that surrounds and isolates the ports and integral flapper valve portions extending from the seal element and overlying the ports, the seal element includes a peripheral portion that encircles the ports and a beam portion that extends transversely across the space between the ports.

10. A valve assembly in accordance with claim 9, wherein the flapper valve portions extend from the beam portion in opposite directions.

11. A valve assembly in accordance with claim 9, wherein the cylinder head end has an outer surface with a recess to receive the portions of the valve member and the valve head has a flat surface sealing against the valve member.

* * * * *